United States Patent [19]

Jacobs et al.

[11] 4,312,627

[45] Jan. 26, 1982

[54] SUSPENSION AND SEAL SYSTEM FOR A REFRIGERATION MOTOR COMPRESSOR

[75] Inventors: John J. Jacobs, Pulaski; Gerhard Kuhn, Clay, both of N.Y.

[73] Assignee: Carrier Corporation, Syracuse, N.Y.

[21] Appl. No.: 7,866

[22] Filed: Jan. 31, 1979

[51] Int. Cl.[3] ..... F04B 17/00

[52] U.S. Cl. ..... 417/363; 417/902

[58] Field of Search ..... 417/363, 902, 415; 62/295

[56] References Cited

U.S. PATENT DOCUMENTS

| | | | |
|---|---|---|---|
| 2,107,819 | 2/1938 | Faber | 417/363 X |
| 2,721,028 | 10/1955 | Dills | 417/902 X |
| 3,008,629 | 11/1961 | Gerteis | 417/415 UX |
| 3,021,995 | 2/1962 | Neubauer | 417/902 X |
| 3,465,954 | 9/1969 | Elis | 417/363 |

*Primary Examiner*—Richard E. Gluck

*Attorney, Agent, or Firm*—J. Raymond Curtin; John S. Sensny

[57] ABSTRACT

A suspension and seal system for a motor compressor unit mounted within a hermetically sealed shell. The shell defines at least one chamber filled with refrigerant suction gas and a second chamber filled with refrigerant discharge gas. The compressor's cylinder block includes a radially extending wall member. A second wall member is spaced from the first wall member for defining a space for receiving a combination seal and suspension member. Resilient members are provided at predetermined locations about the motor compressor unit and are squeezed between opposed surfaces of the unit and the shell for dampening motion of the unit within the shell.

8 Claims, 3 Drawing Figures

SUSPENSION AND SEAL SYSTEM FOR A REFRIGERATION MOTOR COMPRESSOR

BACKGROUND OF THE INVENTION

This invention relates to a suspension and seal system for a refrigeration motor compressor unit, and in particular, to such a system particularly suitable for use in hermetically sealed units wherein refrigerant gas at discharge pressure substantially surrounds the motor compressor unit mounted within a chamber defined by the hermetically sealed shell.

It is well recognized that a motor compressor unit mounted within a hermetically sealed shell must be resiliently supported to prevent noise transmission from the interior of the shell to the exterior thereof. In addition, the support or suspension system must function to minimize or eliminate extensive movement of the motor compressor unit in the shell such as might occur due to torsional forces developed during start-up of the unit. It is essential that excessive unit movement of the motor compressor unit within the shell be prevented to prevent damage to components thereof, such as the motor windings and lubricating oil pump.

It has been found that the energy efficiency of a motor compressor unit can be significantly increased by filling the chamber in which the motor compressor unit is mounted with refrigerant gas at discharge pressure. Heretofore, it has been the practice to fill the chamber with gas at suction pressure, with the gas cooling the motor's windings prior to entry into the compressor's cylinders. In the present arrangement, the suction gas is not used for motor cooling, but rather is led to a relatively small chamber in direct flow communication with the compressor cylinder. The temperature of the gas is thus maintained at a minimum prior to compression. To insure minimum heat transfer between the relatively high temperature refrigerant gas contained within the major portion of the shell and the relatively low temperature refrigerant gas contained within the relatively small chamber adjacent the cylinder, it is necessary to provide a seal.

The present invention particularly relates to a suspension system which, not only supports the motor compressor unit within a hermetically sealed shell, but in addition, provides a seal for physically separating suction gas from discharge gas and for minimizing heat transfer between the suction and discharge gas.

SUMMARY OF THE INVENTION

It is, therefore, an object of this invention to support and seal a motor compressor unit within a hermetically sealed shell having a first chamber filled with relatively high temperature discharge gas and a second chamber filled with relatively low temperature suction gas.

It is another object of this invention to utilize a portion of the suspension system of a motor compressor unit as a seal to achieve minimum heat transfer between the suction and discharge gas.

It is a further object of this invention to dampen the movement of a motor compressor unit within a hermetically sealed shell, and in addition to seal the suction and discharge gas chambers of the shell relative to each other.

It is yet another object of this invention to minimize noise radiated from the motor compressor unit.

These and other objects of the present invention are attained in a suspension and seal system for a refrigeration motor compressor unit hermetically sealed within a shell. The shell includes a first chamber filled with relatively low temperature suction gas and a second chamber filled with relatively high temperature discharge gas. The reciprocating compressor mounted within the shell includes a cylinder block defining at least one cylinder and having a wall member extending therefrom for defining a first radially extending wall. The suspension and seal system further includes a second radially extending wall, spaced from said first wall. A resilient seal and support member is captured within the space defined between said walls and acts as a seal between the first and second chambers of the shell and additionally supports the compressor in a vertical plane taken through the shell. Further resilient suspension means are provided having a first surface in contact with the exterior surface of the motor compressor unit and a second surface in contact with the interior surface of the shell for resiliently suspending the motor compressor unit within the shell.

DESCRIPTION OF THE PREFERRED EMBODIMENT

Figure 1:
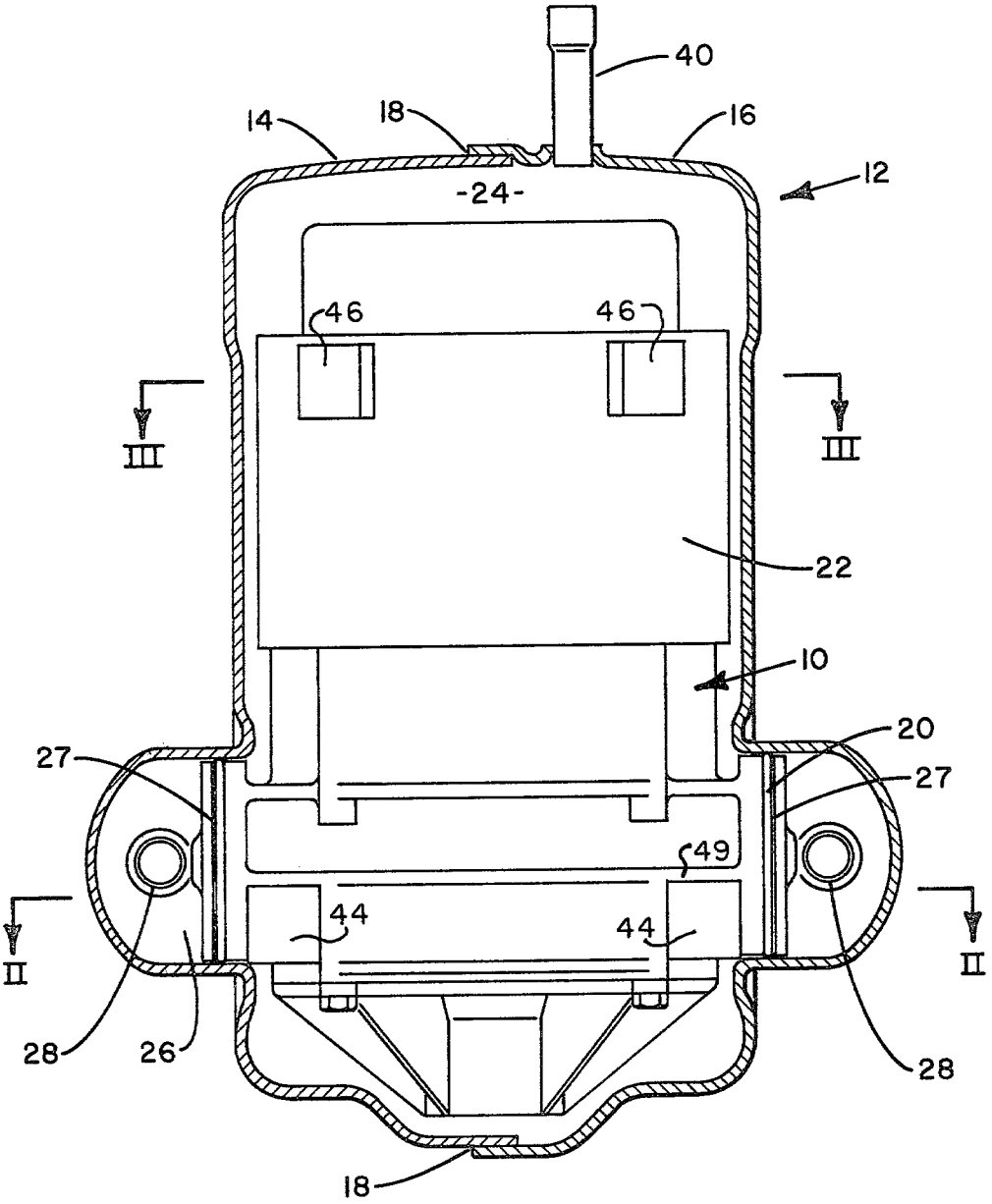
FIG. 1 is a longitudinal plane view, partially in section, of the motor compressor unit mounted within the shell.

Referring now to the drawings there is disclosed a preferred embodiment of the present invention. In referring to the various figures of the drawings, like numerals shall refer to like parts.

Referring particularly to FIG. 1, there is illustrated a motor compressor unit generally designated 10 hermetically sealed within a shell generally designated 12. The shell comprises left and right half sections 14 and 16 sealed together, as by welding, along a vertically extending circumferential seam 18.

Motor compressor unit 10 includes a reciprocating compressor 20 and a motor 22 connected thereto in driving relationship. Compressor 20, in turn, includes compressor block 32 having central body portion 33 and cylinder portions 35. Cylinder portions 35 axially extend outward from central body portion 33 along an axis defined by the cylinder portions, and the cylinder portions define cylinder chambers 30. Shell 12 defines a first relatively large chamber 24 in which the motor compressor unit 10 is generally suspended. Shell 12 further defines a second relatively small chamber 26 adjacent each cylinder 30 of compressor 20. As the disclosed embodiment illustrates a two cylinder compressor, two chambers 26 are provided. Refrigerant gas to be compressed is delivered into chambers 26 via suction lines 28. As is well recognized, suction lines 28 are connected to the evaporator (not shown) of a conventional refrigeration unit. The flow of gas from chambers 26 into cylinders 30 is controlled by the operation of suction valve 27 mounted between valve plate 29 and a radially extending surface 31 of cylinder portion 35.

Cylinders 30 are defined by compressor block 32. As is well known to those skilled in the art, the refrigerant gas delivered into each cylinder 30 is compressed by the reciprocating movement of piston 34 therewithin. Pistons 34 include a discharge valve 39 defining the top surface of each piston and are operatively connected to a scotch yoke mechanism generally designated 36 which moves in response to rotation of shaft 38 to provide reciprocating movement of pistons 34. The compressed refrigerant gas in each cylinder will open discharge valve 39 and flow into chamber 37 defined by compressor block 32. The refrigerant gas will pass upwardly from chamber 37 through the motor, cooling same, and thence into chamber 24.

Chamber 24 contains refrigerant gas at discharge pressure and temperature. The gas flows to the refrigerant condenser (not shown) from reciprocating compressor 10 via discharge tube 40 provided at the top of shell 12.

It has been found that improved energy efficiency may be obtained from a reciprocating compressor by maintaining the temperature of the suction gas delivered into the cylinders at a relatively low level. Heretofore, it has been the common practice to employ the suction gas to cool the motor windings prior to its delivery into the cylinders of the compressor. In flowing through the windings, the suction gas temperature increases, thereby reducing the overall efficiency of the compressor unit.

In the present arrangement, in order to obtain maximum efficient compressor operation, it is extremely important that the suction gas be maintained completely separate from the discharge gas to prevent heat transfer therebetween. Thus, the suction gas is delivered directly into chambers 26 of the shell operating at suction pressure. To achieve the necessary seal between the suction gas chamber 26 and discharge gas chambers 24 and 37, motor compressor unit 10 includes flange portions 42, planar members, preferably defined by suction valves 27, disposed adjacent thereto; and resilient seal and suspension members, for example O-rings 52, captured between flange portions 42 and planar members 27. More particularly, flange portions 42 project from cylinder portions 35 of compressor block 32, toward an interior surface of shell 12, generally perpendicular to the axis of the cylinders. Flange portions 42, however, are spaced from central body 33 of compressor block 32 and from the interior surface of shell 12. For example, a radial clearance of 0.025" may be maintained between opposed surfaces of shell 12 and flange portions 42. Planar members 27 are located adjacent to flange portions 42 axially outward thereof, and the planar members extend substantially parallel to flange portions 42. O-rings 52 are captured between flange portions 42 and outward planar members 27, have a peripheral surface in contact with the interior surface of shell 12, and function both as a seal and as a support member for motor compressor unit 10. In functioning as a seal, O-rings 52 separate shell 12 into chambers 24 and 26, prevent the flow of refrigerant between these chambers, and minimize heat transfer between suction pressure refrigerant gas in chambers 26 and the discharge pressure gas in chamber 24.

In addition, with particular reference to FIG. 1, a portion of the shell surface in contact with each O-ring 52 is located directly therebelow. Thus, motor compressor unit 10 is supported, via compressor block 32 and O-rings 52, by shell 12 in a vertical plane extending through the shell. The support and suspension system for motor compressor unit 10 further includes a plurality of resilient suspension members 44 and 46, spaced at predetermined locations about reciprocating compressor 20 and motor 22. The resilient suspension members are manufactured from a suitable elastomeric material, such as neoprene. Other resilient material may be employed in lieu of neoprene, as for example, suitable plastics. Resilient suspension members 44 and 46 dampen the vibratory movement of motor compressor unit 10 within shell 12, as for example when starting torsional forces are applied to the motor, or when the motor is subjected to external forces, as for example during shipping. By damping the vibratory motion of motor compressor unit 10 damage thereto is prevented. The resilient suspension members also prevent movement of the motor compressor unit in a horizontal plane passing through shell 12.

Figure 3:
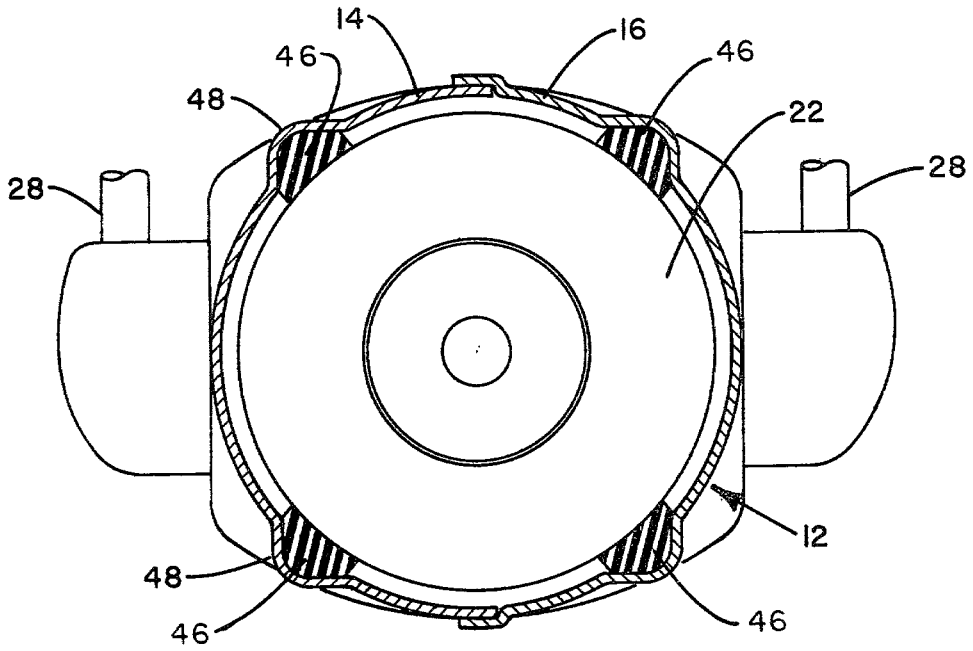
FIG. 3 is a further sectional view taken along line III—III of FIG. 1.
Figure 2:
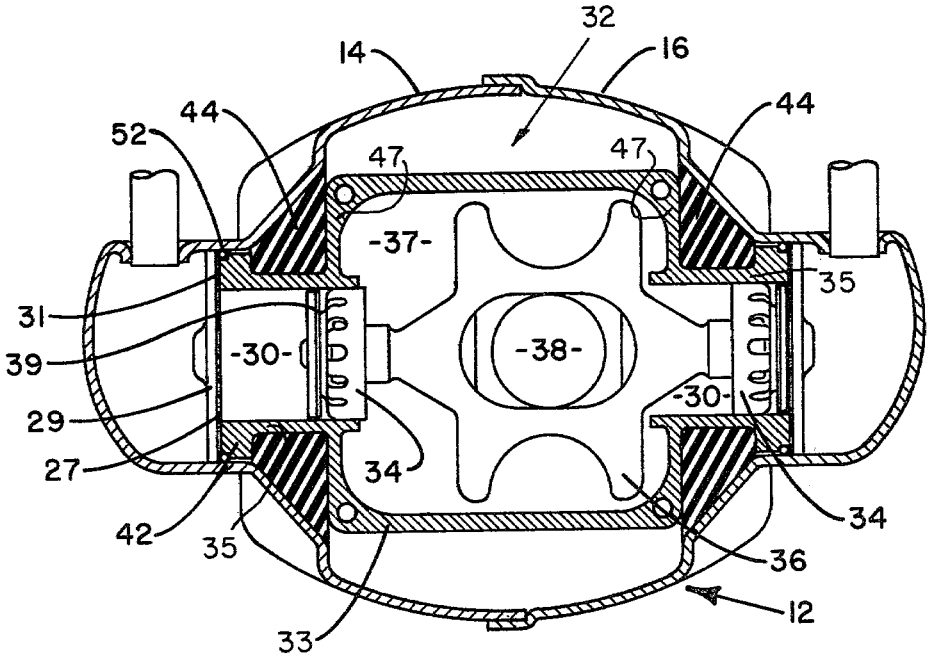
FIG. 2 is a sectional view taken along line II—II of FIG. 1.

Preferably, each of the resilient suspension members 44 and 46 has a first surface in contact with the motor compressor unit and a second surface in contact with the interior surface of the shell whereby the resilient members are squeezed between the respective surfaces of the unit and shell to maintain the position of the members. In a preferred embodiment, the resilient members are formed into two groups, with each group containing an equal number of members. A first group of resilient members 46 is shown in cross section in FIG. 3. Members 46 are trapped between the exterior surface of motor 22 and the interior surface of the shell. Preferably dimples 48 are formed in the shell to more positively capture the resilient members. As illustrated, the shape of resilient members 46 conforms to the shape of the dimples. A second group of resilient members 44, shown in cross section in FIG. 2 is provided between compressor block 32 and the interior surface of the shell. More particularly, preferably compressor block 32 also includes inward planar members 47, which are spaced from flanges 42 and located axially inward thereof. Planar members 47 project from cylinder portions 35 toward the interior surface of shell 12, generally perpendicular to the cylinder axis; and suspension members 44 are squeezed between the interior surface of shell 12, flange portions 42, cylinder portions 35, and inward planar members 47. In this manner, forces tending to move motor compressor unit 10 along the axis of cylinder portions 35 and forces tending to rotate the motor compressor unit in a horizontal plane compress resilient members 44 between the motor compressor unit and the interior surface of the shell. Again, the shape of the resilient members 44 conforms to the shape of the shell portion in contact therewith. Each member of each group of resilient members is equally spaced about the motor or compressor block to equalize the damping achieved through the use of the resilient members, and preferably compressor block 32 also includes horizontal flange portion 49 located adjacent to and above resilient suspension members 44 to inhibit rotation of motor compressor unit 10 in a vertical plane.

The present suspension and seal system for the motor compressor unit achieves a sealing function and minimizes heat transfer between a first chamber filled with refrigerant gas at discharge temperature and pressure and a second chamber filled with gas at suction temperature and pressure, and effectively supports and suspends the motor compressor unit within the shell to prevent damage thereto by preventing excessive movement of the unit within the shell, and reduces transmission of vibration from the compressor to the shell. Further, the suspension and support system utilizes resilient support and suspension members to minimize noise radiated from the motor-compressor unit.

While a preferred embodiment of the present invention has been described and illustrated the invention should not be limited thereto but may be otherwise embodied within the scope of the following claims.

What is claimed is:

1. Suspension and seal apparatus for a motor compressor unit including a compressor block having a central body, and at least one cylinder portion extending axially outward therefrom along an axis defined by the cylinder portion, the suspension and seal apparatus comprising:

a hermetically sealed shell encapsulating the motor compressor unit;

a flange portion projecting from the cylinder portion, toward an interior surface of the shell, generally perpendicular to the cylinder axis, wherein the flange portion is spaced from the central body of the compressor block and from the interior surface of the shell;

an outward planar member located adjacent to the flange portion axially outward thereof, and extending substantially parallel to the flange portion;

a resilient combination seal and support member captured between the flange portion and the outward planar member and having a peripheral surface in contact with the interior surface of the shell to separate the shell into first and second pressure chambers and to seal the first chamber from the second chamber, wherein a portion of the shell surface in contact with the resilient seal and support member is located directly therebelow to support the seal and support member, the compressor block, and the motor compressor unit in a vertical plane extending through the shell; and resilient suspension means squeezed between the interior surface of the shell and surfaces of the motor compressor unit for resiliently suspending the motor compressor unit within the shell.

2. A suspension and seal apparatus as defined by claim 1 wherein:

the compressor block includes an inward planar member spaced from the flange portion and located axially inward thereof, and projecting from the cylinder portion, toward the interior surface of the shell, generally perpendicular to the cylinder axis; and the resilient suspension means includes a group of resilient, compressor engaging members squeezed between the interior surface of the shell, the flange portion, the cylinder portion, and the inward planar member, wherein forces tending to move the motor compressor unit along the cylinder axis and forces tending to rotate the motor compressor unit in a horizontal plane squeeze the compressor engaging resilient members between the motor compressor unit and the interior surface of the shell.

3. A suspension and seal apparatus as defined by claim 2 wherein the motor compressor unit further includes a motor and wherein:

the resilient suspension means further includes a group of resilient, motor engaging members squeezed between the interior surface of the shell and the motor; and the shell defines a plurality of dimples to capture positively the motor engaging resilient members.

4. A suspension and seal system as defined by claim 3 wherein the compressor block further includes a horizontally extending flange located above and adjacent to the compressor engaging resilient members to inhibit rotation of the motor compressor unit in a vertical plane.

5. A suspension and seal apparatus in accordance with claim 4 wherein said compressor engaging resilient members include a first group of elastomeric members symmetrically spaced about the perimeter of said compressor block.

6. A suspension and seal apparatus in accordance with claim 5 wherein said motor engaging resilient members include a second group of elastomeric members equally spaced about the circumference of the motor.

7. A suspension and seal system in accordance with claim 6 wherein the number of said members in the first group of elastomeric members equals the number of said members in the second group.

8. A suspension and seal apparatus in accordance with claim 7 wherein said outward planar member is defined by a suction valve regulating flow of gas into the cylinder portion of said compressor.

* * * * *